United States Patent [19]

Hedlund et al.

[11] 3,940,889

[45] Mar. 2, 1976

[54] METHOD FOR SHARPENING ROTARY BLADES

[75] Inventors: Harland R. Hedlund; Harry K. Wethe, both of St. Paul, Minn.

[73] Assignee: Aladdin Manufacturing Company, Minneapolis, Minn.

[22] Filed: May 5, 1975

[21] Appl. No.: 574,507

[52] U.S. Cl. ..... 51/288; 51/326; 51/328; 76/101 A

[51] Int. Cl.[2] ..... B24B 1/00; B24B 3/60

[58] Field of Search ..... 51/76 BS, 135 R, 138, 285, 51/288, 326, 328; 76/82.1, 85, 101 A

[56] References Cited

UNITED STATES PATENTS

| | | | |
|---|---|---|---|
| 3,499,249 | 3/1970 | Aberle | 51/138 X |
| 3,554,083 | 1/1971 | McKelvy et al. | 51/76 X |
| 3,624,965 | 12/1971 | Geppert | 51/138 X |
| 3,722,144 | 3/1973 | Rickrode et al. | 51/328 X |
| 3,896,592 | 7/1975 | Wintz | 51/135 R |

*Primary Examiner*—Al Lawrence Smith
*Assistant Examiner*—Nicholas P. Godici
*Attorney, Agent, or Firm*—Burd, Braddock & Bartz

[57] ABSTRACT

A generally rectangular, elongated, rotary cutting blade work piece which is to be sharpened on oppositely facing, opposite end portions is conveyed on a flat horizontal path in direction transverse to its longitudinal axis through a grinding and deburring aaparatus. Passage of the work piece through the apparatus is interrupted periodically to position it serially at four work stations. At each station it stops, is precisely positioned, held firmly, and worked on. At a first station it is brought into contact with a belt grinder which sharpens a first of the rotary leading outer end portions of the blade by removing material from it. At a second station this ground portion is brought into contact with a rotary deburring member. At a third station the work piece is brought into contact with a belt grinder to sharpen a second, oppositely facing, rotary leading outer edge portion. At a fourth station, the portion just ground is brought into contact with a deburring member. The positioning of the blade transversely of the conveyor just before each grinding operation is determined by vertical guides on either side of the conveyor.

2 Claims, 6 Drawing Figures

152
160
154
176
198
12
200
162
202
204
206
156
208
216
220
218
166
66
74
180
150
158
18
132
124
122
184
214
126
10
38
102
112
136
106
108
120
16
40
116
14
68
118
20
78
82

5
5
A
A
10
12
14
16
18
20
28
30
32
36
38
54
66
94
100
102
106
108
122
126
128
132
138
150
154
156
158
164
166
168
170
172
174
176
176'
178
180
182
184
186
188
190
192
194
202
204
206
208
210
212
214
216
224
226
228
232
234
238
240
242
244
246
248
250
252
254
256
258

METHOD FOR SHARPENING ROTARY BLADES

BACKGROUND OF THE INVENTION

Grinding or sharpening through the use of belt grinders whereby a contact wheel is powered to drive an endless abrasive belt which is riding over an idler pulley is well known in the art. Customarily such grinding was accomplished by bringing the entire forward facing surface of the work piece to be ground flat against the abrasive belt where it is backed by the contact wheel. Recently, however, one edge of a contact wheel has been relieved on a radius, and an endless belt positioned to extend out over this relieved radius and beyond the outer edge of the contact wheel. Work pushed against this abrasive belt and contact wheel results in grinding pressure being exerted, not only on the portion of the work piece in contact with the cylindrically supported portion of the abrasive belt, but also on that portion extending out beyond the wheel. The pressure varies from full pressure over the belt backed by the contact wheel to the point where the belt parts contact with the work. The only pressure beyond the contact wheel is that occasioned by the centrifugal action of the abrasive belt itself. The result achieved is a smooth, even taper from the point of full backup contact by the wheel to the point where the abrasive belt is no longer in contact with the work piece.

The same result can be achieved with the use of a dressed carbide cutting wheel, but the exact shape of the carbide wheel at any particular point in time is directly related to its original shape and the amount of work piece material which has previously been removed by the wheel. The wheel is abraded away each time it is brought in contact with a work piece, and so its shape is constantly changing. To pressure balance in the rotary blade work piece, therefore, it is necessary that each end of the grinding blade be sharpened in consecutive order on the same carbide cutter wheel. In other words, the blade has to be sharpened on one end, and then reversed end for end and sharpened on the other end to insure that the only difference in the shape of the carbide cutter from the beginning of the first sharpening to the end of the second sharpening is occasioned by the wear on the cutter during those two sharpening operations.

Since the very process of cutting causes the carbide cutter wheel to be abraded away, it is not precisely the shape to which it is dressed after it first removes its first material on the first cut after it has been dressed. Thus many interruptions of the grinding process are necessary so that the carbide cutter can be redressed to the proper shape.

Also, each time the wheel is so dressed, the working diameter of the wheel is reduced, so the jigs holding the work pieces to be ground by the carbide cutters cannot continuously hold the blades for an accurate cut, and must somehow be modified to take this change in outer diameter of the cutter into consideration.

Working with carbide cutters in the manner set out above, one man can sharpen a maximum of about 1,800 blades per day at a processing cost of about 6 cents per blade.

Needed to overcome the difficulties with the prior art methods was an apparatus whereby precisely identical cuts can be made at each end of work piece rotary blades, time after time after time, so that the blades will not have to be turned end for end and exposed to sharpening by the same grinding means at each end of the blade.

BRIEF SUMMARY OF THE INVENTION

The sharpening of opposite end portions of rotary cutting blades to provide opposed, rotary forwardly facing cutting edges is described herein in connection with blades useful on rotary lawnmowers. The apparatus of the invention will be equally effective as to many other kinds of rotary cutting, commutating, or slicing blades.

Comparing the production figures of an apparatus of the present invention with the 1,800 blade per day production of one man using carbide cutters, costing about 6 cents per blade; the apparatus of the invention can be operated by one man, and can produce in the neighborhood of 5,600 blades per day at a cost of about 3 cents per blade.

In the form of the invention as shown, a rotary cutting blade is generally constituted as a generally flat, rectangular, elongated work piece having an opening or openings at the center thereof for supporting the blade and for rotating it when it is to be used for its intended purpose. In an apparatus of the invention, such blades progress down a longitudinally extending conveyor; with the longidutinal axis of each blade being positioned transverse to the longitudinal axis of the conveyor. In the form of the invention as shown, vertical drive tabs extend upwardly from endless conveyor chains or bands. The progress of each work piece blade along the conveyor is interrupted at specific work stations along the conveyor. At one of these work stations, each blade is precisely positioned with respect to a belt grinder, is held firmly and is brought into contact with the belt grinder to remove a portion of a first longitudinally extending end section of the work piece blade. When this has been accomplished, the work piece moves longitudinally along the conveyor, that is to say transversely of the longitudinal axis of the work piece and is stopped at another work station where it is precisely positioned with respect to a second belt grinder, firmly held and brought in contact with that belt grinder to remove a portion of a transversely extending opposite end section of the work piece, this second transverse portion forming a cutting edge along a longitudinally extending side of the work piece opposite the side where the first cutting edge was formed.

In the form of the invention as shown, the first transverse cutting edge is formed on the leading edge of the work piece as it moves along the conveyor, and the second cutting edge is formed on the trailing edge of that work piece. It is to be understood, however, that these work stations could be reversed and the initial sharpening could be done on the trailing edge while the subsequent sharpening could be done on the leading edge.

Also in the form of the invention as shown, there is a work station at which the work piece stops immediately after each grinding work station, and at these work stations, the ground portions of the work piece blades are brought into contact with rotary deburring members to remove burrs which are set up in the grinding operations. These deburring operations can both take place at the same work station located at position following the second grinding station, or can also be performed after the work piece left the apparatus of the invention.

Because of considerations of space in the apparatus itself, however, there are distinct advantages to performing the operations on each work piece in the order set out in detail in connection with the specific embodiment which follows.

In the form of the invention as shown, the precise positioning of each work piece at each work station is accomplished by providing positioning fingers which are in the path of each work piece as it passes along the conveyor. Each time a work piece contacts such a positioning finger, the conveyor stops leaving that work piece precisely positioned with respect to that work station. Each of the work stations is so located that when any work piece is contacted by any positioning finger to stop the conveyor, any other work piece on the conveyor in proximity to any other work station will be precisely positioned with respect to that station. In this description, one pair of such positioning fingers are shown at the first work station, and this will be satisfactory if there is a work piece being driven by each set of drive tabs on the conveyor at least as it arrives at the first work station. Such positioning fingers can be provided at each work station, and then the absence of a work piece at any particular work station will not interfere with the proper processing of work pieces at the other stations.

With the conveyor stopped at the proper position to align the work pieces with the work stations, the positioning fingers are withdrawn and a saddle block moves up through the conveyor to lift the work material and to clamp it in a positioning jig.

At each grinding station, the moving contact wheel and endless abrasive belt of a belt sander are moved to work on the proper portion of the work piece and such movement is limited by appropriate stops so that the final grind at each station varies only the variation in thickness of abrasive on the abrasive belt as the belt progresses from new condition to replacement condition. These stops can be in the form of physical limitations of movement of the contact wheel and belt with respect to the clamping jig, or can be in terms of the amount of pressure applied by the contact wheel and belt against the work piece, the quality and nature of the abrasive, the peripheral speed of the belt, and the time that grinding contact is maintained, or can be a combination of the physical movement limit with the other factors.

At each deburring station, the work piece is picked up by a saddle block, clamped into a jig and a rapidly rotating abrasive deburring wheel having flexible or resilient abrasive elements thereon is brought into contact with the ground portion of the work piece thus to remove the burrs therefrom.

From the point where each work piece is placed on the conveyor and picked up for movement by the conveyor drive tabs, vertical guide plates are provided to contact the outermost ends of the work piece to assure that it is in the precise position transversely of the direction of movement of the conveyor belt relative to the abrasive belts and contact wheels so that proper portion of the work piece will be ground at each grinding work station. This position is also maintained as the work material moves from each grinding station to its related deburring station.

IN THE DRAWINGS

FIG. 1 is a top plan view of an apparatus made according to the present invention;

DESCRIPTION OF PREFERRED EMBODIMENT

Figure 2:
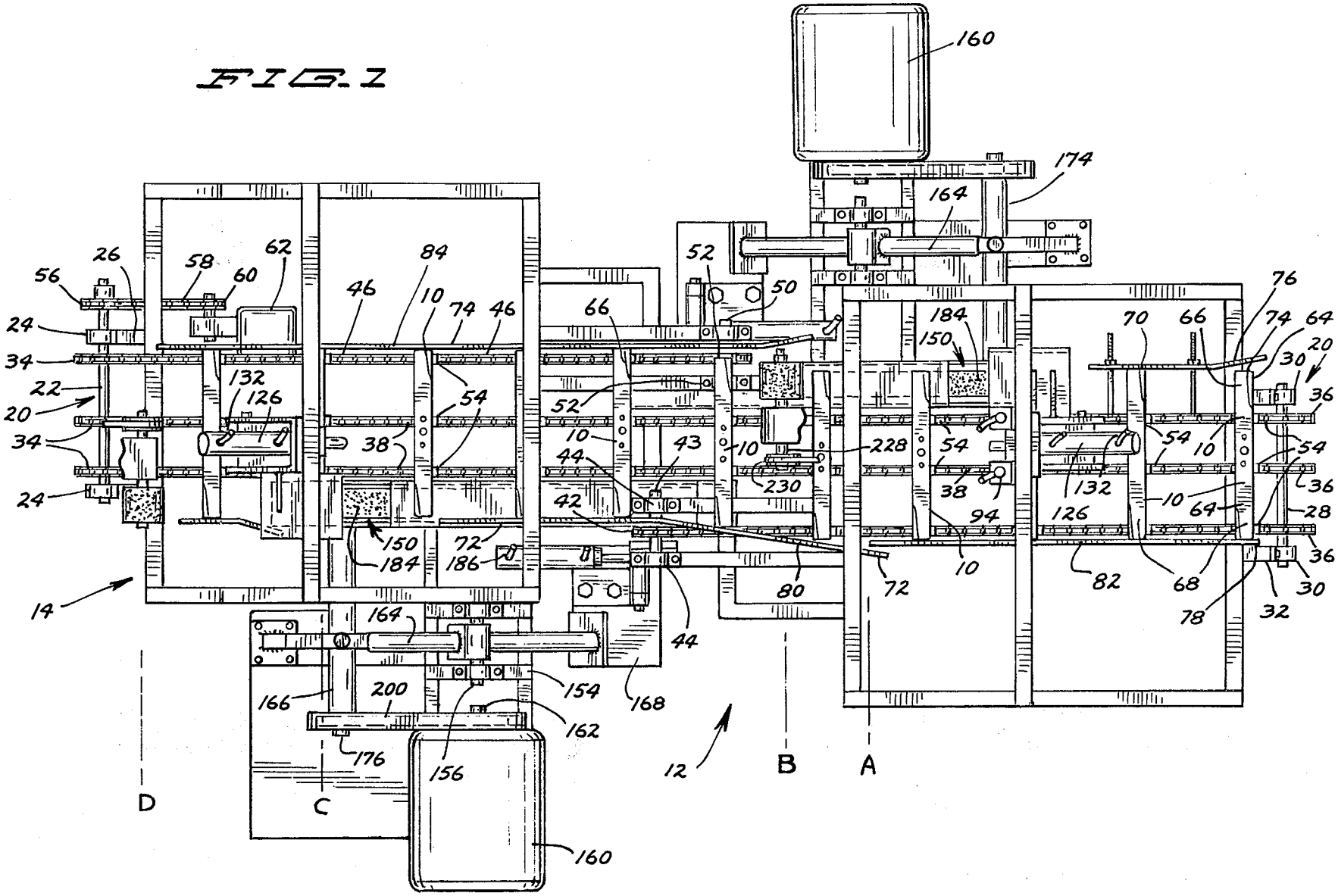
FIG. 2 is a side elevational view of the apparatus of FIG. 1.
Figure 2:
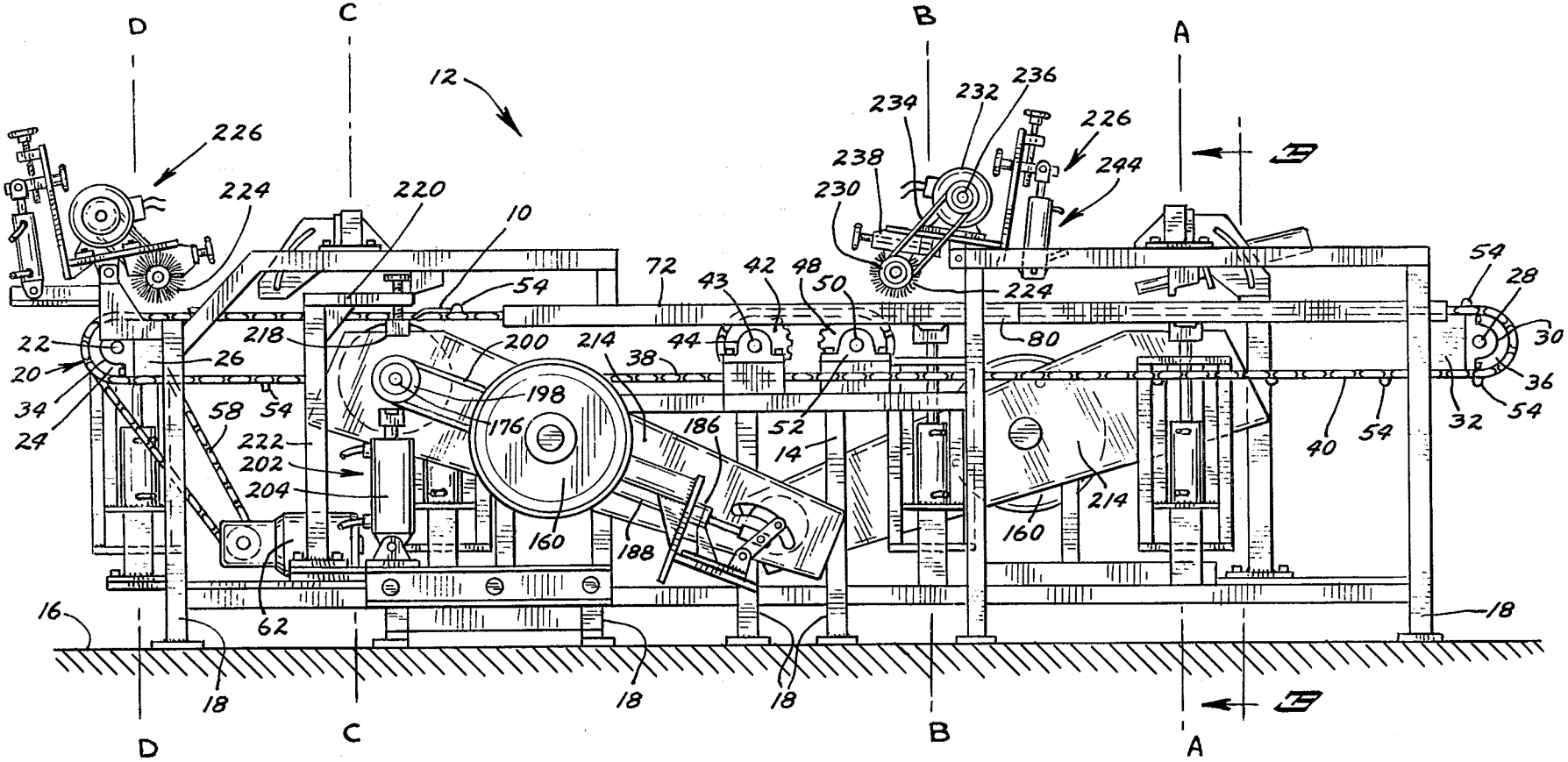

For sharpening generally rectangular, elongated, rotary cutting blade or lawnmower blade work pieces 10, a blade sharpening apparatus 12 includes a main frame 14 supported on a floor 16 by legs 18.

A work piece conveyor 20 includes a driven axle 22 rotatably mounted in driven axle bearings 24, 24, these bearings being fixedly mounted to the frame 14 on horizontal rearward frame extensions 26. At the front end of main frame 14, an idler axle 28 of the conveyor 30 is rotatably mounted in idler axle bearings 30, 30. These idler axle bearings 30, 30 are supported on the frame 14 by horizontal front frame extensions 32.

Three conveyor drive sprockets 34 are integrally mounted to rotate with the driven axle 22 while three conveyor idler sprockets 36 are integrally mounted to rotate with the idler axle 28. Two central, parallel, spaced apart conveyor chains or bands 38, 38 are each drivingly associated with one of the drive sprockets and one of the idler sprockets. A front end conveyor chain or band 40 is drivingly associated with the remaining idler sprocket 36 and with the front end conveyor sprocket 42 rotatably mounted on an axle 43 which is rotatably supported in bearings 44, 44 supported on the frame 14.

Similarly, a rear end conveyor band or chain 46 is drivingly supported on the remaining drive sprocket 34 and is operatively associated with a rear end conveyor sprocket 48 which is mounted to rotate with a rear end conveyor axle 50, rotatably mounted in bearing 52, 52 on the main frame 14. A plurality of upstanding conveyor chain drive tabs 54 are situated in spaced apart relationship on all of the conveyor chains. This relationship is such that each drive tab 54 is in transverse relationship with respect to a similar tab 54, on all other parallel conveyor chains, to the end that a work piece 10 moving along the conveyor will be uniformly contacted by a tab on every chain which it overlies at a particular point in time.

Drive sprockets 34 and axle 22 at the rear end of the main frame 14 are driven through a driven sprocket 56 integral with axle 22, a conveyor drive chain 58 runs on that sprocket 56 and on a gear motor sprocket 60 which is driven by conveyor drive gear motor 62.

Through these instrumentalities, the work piece conveyor 20 moves the work pieces intermittently along, stopping as each of the work pieces arrives serially at one after another of four work stations along the conveyor route through the machine, in a manner to be described.

The approximate positioning of work pieces 10 when at each of the work stations is indicated by letters A through D, and these four work stations are delineated as follows:

Station A. First leading edge grinding station;

Station B. Second leading edge deburring station;
Station C. Third trailing edge grinding station; and
Station D. Fourth trailing edge deburring station.

The rotary cutting blade work pieces 10 are first positioned on the conveyor 20 to the right as seen in FIGS. 1 and 2 by automatically or manually placing them over the central conveyor chains 38, 38 and the front end conveyor chain 40 at position as seen in 64 in FIG. 1. The work piece 10 is held in that position either by placing it on runners which extend up higher than the top surface of the chains (not shown), or by holding it manually until such time as a set of drive tabs 54 come along to contact the work piece and begin to carry it along the horizontal path of the conveyor.

Each of the work pieces, to be effective on a rotary cutter such as a rotary lawn mower, will have to be sharpened along a longitudinally extending leading edge portion 66 and along a longitudinally extending trailing edge portion 68 thereof. In order to properly grind these portions, an outermost end 74 of the work piece 10 adjacent the leading cutting edge portion 66 must be exactly positioned with respect to the Station A belt grinder and an outermost end 78 of work piece 10 adjacent the trailing cutting edge 68 must be exactly positioned with respect to the Station C belt grinder. This is accomplished by a Station A guide plate 70 and a Station C guide plate 72. When the work piece 10 is put onto the work piece conveyor 20 at the position as indicated at 64 in FIG. 1, care is taken to insure that outermost end 74 of the leading edge portion 66 of that work piece is positioned where it will make contact with Station A guide plate 70 before it passes an outwardly flared forward portion 76 of that guide plate. Then as the work piece moves to the left as seen in FIG. 1, its outermost end 74 will be contacted and, if necessary, the work piece pushed transversely of the conveyor chains 38, 38, thus to have a precisely determined relationship to grinding Station A.

After the grinding operation has been performed on the leading edge portion 66 of the work piece 10 at that grinding station, in a manner to be described, the conveyor will move the work piece to deburring Station B, where it will still be in approximately the same transverse alignment with respect to the conveyor chains 38, 38. The deburring operation is there performed in a manner to be described, and the work piece moves to the left as seen in FIG. 1, for example, until outermost end 78 of the trailing edge portion 68 of the work piece 10 contacts an outwardly flared forward portion 80 of the Station C guide plate 72. This outwardly flared portion 80 forces the work piece 10 to move transversely with respect to the conveyor chains 38, 38 as these conveyor chains and their drive tabs 54 carry the work piece to the left as seen in FIG. 1, for example, Thus the precisely proper transverse alignment of the work piece with respect to the conveyor chains and with respect to grinding Station C is obtained, and the work piece proceeds down the conveyor in such alignment until it reaches grinding Station C where the trailing edge portion 68 is ground in a manner to be described.

In the form of the invention as shown, guide plates 80 and 82 parallel to the conveyor belt are shown at the opposite ends of the work piece from guide plates 70 and 72. As shown, these guide plates are so positioned as to be substantially in contact with the opposite end of the work piece while the aligning guide plates 70 and 72 are in contact with that work piece. This situation can prevail where the apparatus is set up to handle work pieces of a single set maximum length. However, when shorter work pieces of several lengths are to be processed, the guide plates 70 and 72 are important to insure precise alignment with the grinding Stations A and C regardless of the length of the work piece.

Another important advantage of this use of guide plates to fix and control the transverse positioning of the work piece with respect to the apparatus is one of economy in the space taken by the machine. If a work piece was to proceed down the conveyor without any transverse movement between the first leading edge grinding operation and the second trailing edge grinding operation, then the overall machine would have to be much wider, this wide space being wasteful and completely unnecessary when the transverse alignment techniques just described are employed.

In order to regulate the movement of the conveyor belts, a microswitch 86 is mounted on the frame 14 (see FIG. 5) and includes a switch arm 88 which is in contact with a stop finger support yoke 90. Support yoke 90 is pivotally mounted as at 92 to the frame 14, and rests against a pair of double acting linear, air operated, stop finger drive motors 94, 94. These drive motors are likewise supported on the frame 14, but are free to move away from it sufficiently to operate the switch arm 88 of the microswitch 86. Work piece stop fingers 96, 96 extend downwardly from the air operated piston-cylinder motors 94, 94 as piston rods of those motors and extend into the path of the work pieces 10 as they move along with conveyor chains 38, 38, as best seen in dotted lines in FIG. 6. As soon as one of the work pieces contacts fingers 96, 96, these fingers cause the stop finger drive motors 94, 94 to move almost imperceptibly away from the frame 14, pushing yoke 90 in the same direction, and causing it to operate on switch arm 88 of the microswitch 86. Upon operation of this switch, control means of any usual or preferred construction (not shown) (1) de-energizes the drive from gear motor 62, instantaneously locking all of the drive chains in position, and (2) causes air under pressure to be introduced into a line 98 to activate drive motors 94 to raise stop fingers 96, 96 to position as shown in full lines in FIG. 5.

At the same time, the work piece 10 is lifted from the conveyor belts and precisely positioned for grinding, in appropriate saddles and jigs in a manner to be described. The positioning of the conveyor chain drive tabs 54 along the conveyor chains is such that whenever a work piece 10 triggers such a stoppage of the conveyor belt, it and three other work pieces will be precisely aligned with the saddles and jigs at the work stations. Assuming that every set of drive tabs 54 has a work piece positioned in front of it, it is only necessary to have one set of stop fingers and controls to insure that every work piece is worked on at each of the four stations. By providing stop fingers and associated controls at each of the four work stations, however, it is possible to insure that every work piece passing through the apparatus will be processed at all four stations whether or not there is a work piece associated with each set of drive tabs 54.

To precisely position each work piece as it arrives at each of the four stations, A, B, C and D, a jig 100 is fixedly mounted to the frame 14 at each of those stations. In vertical alignment below each such jig is a saddle block 102, operatively mounted with respect to a piston rod 104 of a linear, air operated, cylinder-piston motor 106. Each such motor includes a cylinder 108 fixedly mounted with respect to the frame 14, and a piston 110 operably associated with cylinder 108 and with piston rod 104. A rectilinear work piece lifting frame 112 is mounted to move up and down with the saddle block 102 and the piston rod 104 as at 114 (see FIGS. 5 and 6) and supports a work piece lifting arm 116 and a work piece lifting rod 118 (see FIG. 5).

Figure 6:
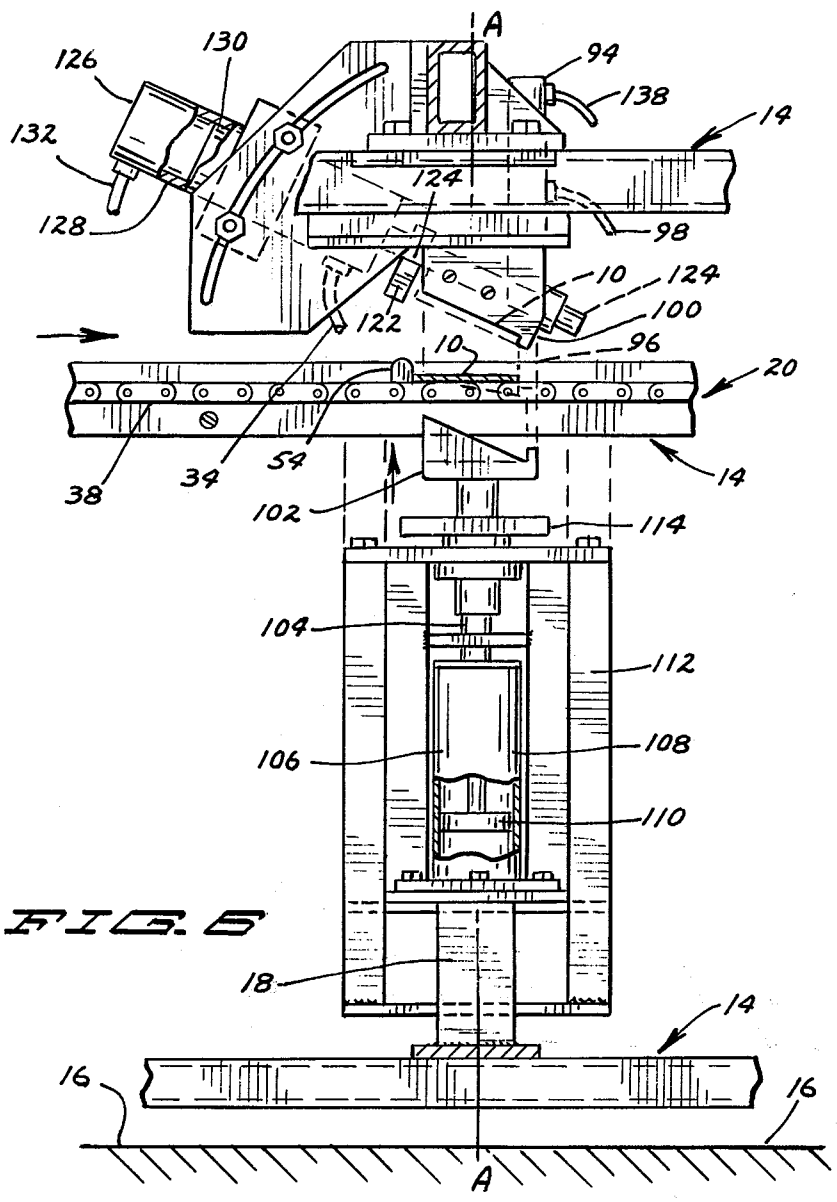
FIG. 6 is a fragmentary vertical sectional view taken on the line 6—6 in FIG. 5.

When a work piece 10 arrives at a work station, for example Work Station A, and the control means causes the conveyor chains to stop and the work piece stop fingers 96, 96 to be drawn up out of the way, this control means then causes air under pressure to be introduced into air line 120 from a source (not shown) to cause piston 110, piston rod 104, and saddle block 102 to be elevated, carrying the work piece to position as seen in dotted lines in FIG. 6.

Figure 4:
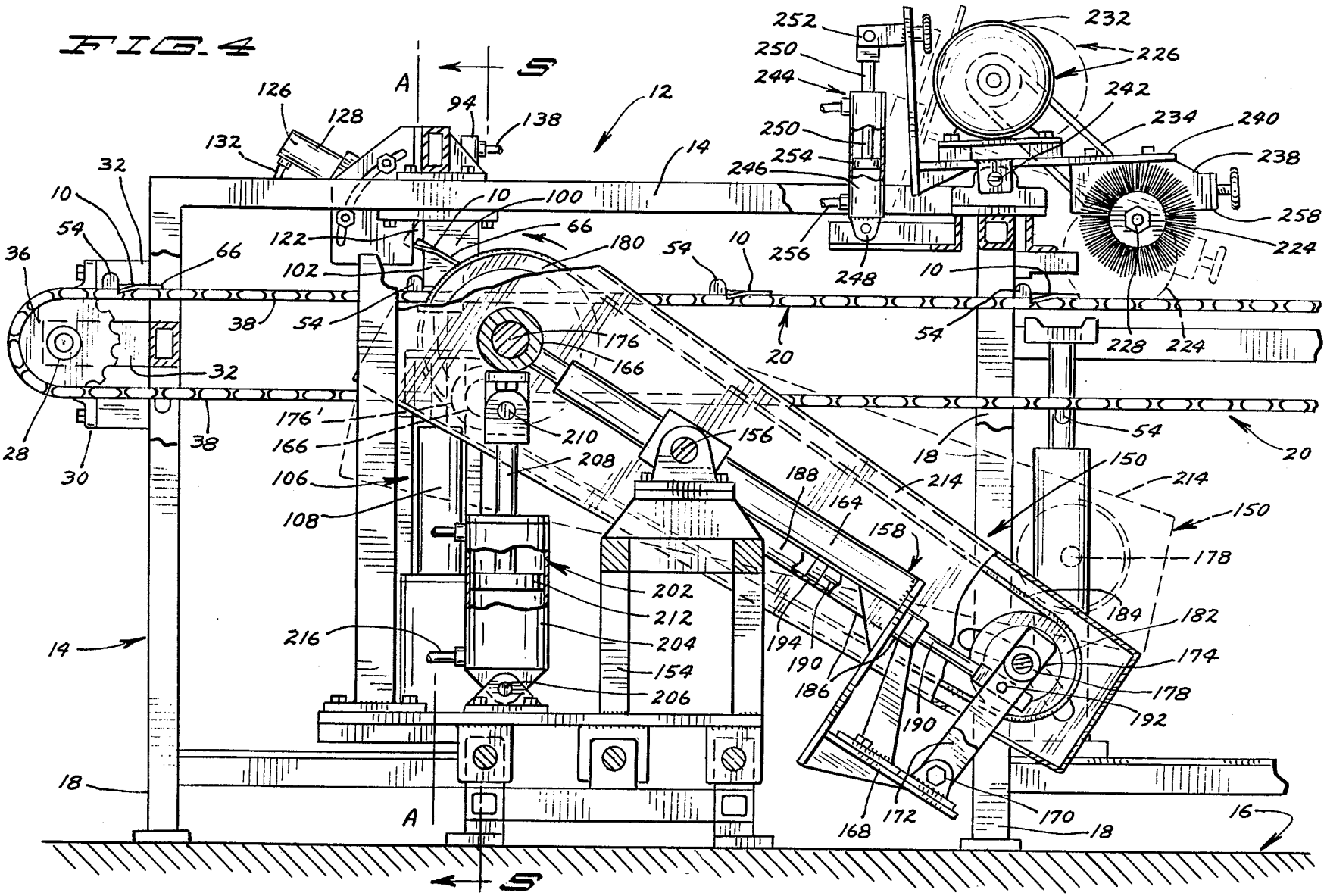
FIG. 4 is a vertical sectional view taken on the line 4—4 in FIG. 3.

A work piece clamp 122, fixedly mounted in a piston rod 124 of a linear, air operated, piston-cylinder clamp motor 126 will be activated by that motor to move firmly in against the trailing edge of the work piece 10 to insure that the work piece is firmly fixedly positioned between the jig 100, the saddle block 102 and the clamp 122. This positioning of the parts is seen in FIG. 4.

In order to move the piston rod 124 and the work piece clamp 122 to position where the clamp can so hold the work piece 10, the clamp motor 126 is provided with a cylinder 128, and a piston 130 operably associated with the cylinder and with the piston rod 124. In order to move into its clamping position, the motor 126 receives air through an upper air line 132, thus to force the piston 130, piston rod 124 and clamp 122 in downward clamping direction.

With a work piece 10 precisely and fixedly positioned in its associated jig 100 at each of the work stations, the grinding or deburring operation will be performed on it in a manner to be described. When this operation is completed, (1) air under pressure is introduced into a lower air line 134 and into the cylinder 128 to move the clamp 122 away from the work piece 10; (2) air is introduced into upper air line 136 and into the cylinder 108 of the saddle block motor 106 to move the saddle block 102 and work piece 10 down away from the jig 100, depositing the work piece on the conveyor chains 38, 38; and (3), the conveyor chains are agains powered by conveyor drive gear motor 62 to cause each of the work pieces to move on toward the next work station, or off of the end of the apparatus.

It is to be noted that while the jig, saddle block and clamp structures have been most clearly illustrated in connection with Station A, identical or similar structures are located at each of the other three stations. When the saddle block 102 and piston rod 104 come up between conveyor chains 38, 38 the work piece lifting rod 118 comes up simultaneously on the far side of conveyor chain 40 from chains 38, 38, to lift an outer end portion of the work piece 10 and maintain it in a parallel relationship with respect to the bed of the conveyor chains and to the clamping faces of the jig 100 and the saddle block 12. This upper positioning of the lifting rod 118 and the work piece 10 are most clearly indicated in dotted lines in FIG. 5; and the lower positioning thereof in full lines in FIGS. 3 and 5.

As the conveyor chains 38, 38 and 40 and conveyor chain drive tabs 54 move the work piece 10 past the work station, air under pressure is introduced into upper air line 138 leading to the upper part of stop finger drive motors 94, 94 to move stop fingers 96, 96 again down to position as seen in dotted lines in FIG. 6 so that they will be in a position to halt the conveyor chains once again when the next work piece 10 comes in contact with them.

With a work piece 10 clamped in position at each of the four work stations, A, B, C and D, a grinding operation is performed on each work piece at Stations A and C and a deburring operation is performed on the work pieces at Stations B and D. The details of construction and operation of the grinding apparatus are shown most fully and most clearly at Station A, and the details and construction of the deburring apparatus is shown most clearly as at Station B. However, the structures at Stations C and D are equivalent to those at A and B, respectively except that they are such as to work on the opposite trailing edge portion of the work piece.

Figure 3:
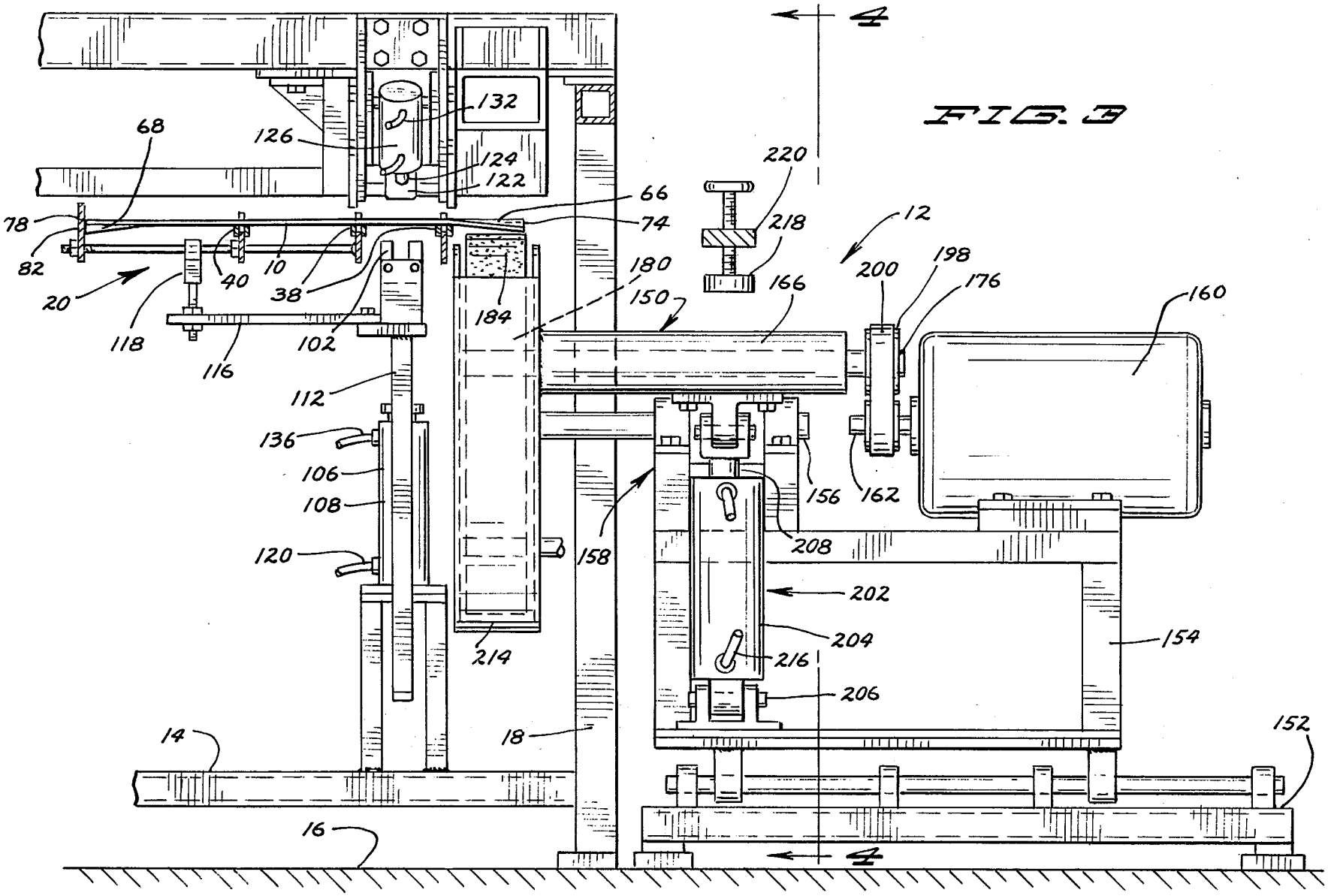
FIG. 3 is an enlarged vertical sectional view taken on the line 3—3 in FIG. 2.

As most clearly seen in FIGS. 2, 3 and 4, a belt grinder 150 includes a grinder base 152 supported by the floor 16 and capable of being moved with respect to the main frame 14 should it be necessary or desirable to change the relative positioning of the grinding entity with respect to the work piece 10 held in the jig-saddle block-clamp. A stanchion 154 extends upwardly from the base 152 to provide support for a pivot rod 156 for a main contact wheel and idler wheel support beam structure 158. The stanchion 154 also provides a support for a belt grinder motor 160. This motor has a shaft 162 which is in exact axial alignment with pivot rod 156.

Support beam structure 158 includes a support beam 164, and an elongated contact wheel shaft bearing 166 integral with beam 164 and extending transversely of it. At the opposite or lower end of the beam, an idler wheel bracket platform 168 is fixedly and rigidly mounted with respect to the support beam 164. This platform pivotally supports, as at 170, an idler wheel bracket 172. This bracket includes at an upper end thereof, an integral transversely extending idler wheel shaft bearing 174.

A contact wheel shaft 176 is rotatably supported in the contact wheel shaft bearing 166, an idler wheel shaft 178 is rotatably mounted in idler wheel shaft bearing 174; while a contact wheel 180 is fixedly mounted on the contact wheel shaft and an idler wheel 182 is fixedly mounted on the idler wheel shaft. An abrasive grinder belt 184 is operably associated with contact wheel 180 and idler wheel 182.

A linear, air operated, piston-cylinder belt tension motor 186 includes a cylinder 188 fixedly mounted with respect to the support beam 164 and the idler wheel bracket platform 168. A piston rod 190 pivotally mounted with respect to idler wheel bracket 172 at 192, and a piston 194 is operably associated with cylinder 188 and piston rod 190. Air from a source not shown can enter the head end of cylinder 188 to maintain the predetermined tension on abrasive grinder belt 184 by exerting an outward force, through the piston rod 190 on idler wheel shaft 178 and the idler wheel 182 during grinding operations. Air can be introduced into the rod end of cylinder 188 to move the idler wheel close to the contact wheel when it is necessary to replace the grinder belt 184. This arrangement allows the shut down time for belt replacement to be reduced to the barest minimum.

The contact wheel, idler wheel, grinder belt assembly is power driven to move the contact wheel and idler wheel in counter-clockwise direction as seen in FIG. 4, for example, through the instrumentality of the belt grinder motor 160, motor shaft 162, a grinder motor pulley 196 integral with the shaft 162, a contact wheel drive pulley 198, contact wheel shaft 176, and a grinder drive belt 200 operably associated with grinder wheel pulley 196 and contact wheel pulley 198. See FIG. 3.

A linear, air operated, piston-cylinder belt grinder positioning motor 202 includes a cylinder 204 pivotally mounted as at 206 to the grinder base 152, a piston rod 208 pivotally mounted as at 210 to the elongated contact wheel shaft bearing 166, and a piston 212 operably associated with piston rod 208 and cylinder 204.

For the purpose of containing the metal dust and abrasive dust which is the result of the grinding operation, a substantially all encompassing sheet metal cover 214 is situated around the contact wheel, grinder belt, idler wheel and support beam 164, this cover being fixedly mounted with respect to the support beam 164 to move with it. Means is provided for carrying this deliterious grinding by-product away from the apparatus, but such means has been omitted from the present disclosure in the interest of clarity.

When the conveyor chains 38, 38, 40 and 46 are in operation, and work pieces 10 are moving with the chains and tabs 54 through the machine, the belt grinder assembly 150 will be positioned as seen in dotted lines in FIG. 4. See specifically the dotted position of the contact wheel shaft bearing 166, the contact wheel shaft 176, and the idler wheel shaft 178 in FIG. 4. After the conveyor chains stop, and the work piece 10 is positioned by the saddle block 102, the jig 100, and the clamp 122 as seen in FIG. 4, air will be introduced through lower line 216 into the lower head end of the cylinder 204 to force piston 212 in upward direction to bring grinder belt 184 and contact wheel 180 into grinding relationship to the longitudinally extending leading edge porton 66 of the work piece 10.

As best seen in FIG. 2, a vertically adjustable contact wheel limit stop 218 is threadably mounted in a limit stop support bar 220 which in turn is integral with downwardly extending limit stop support post 222, which itself is fixedly mounted on the main frame 14. The positioning of the contact wheel limit stop 218 will be such that further upward movement of the contact wheel 180 and the grinder belt 184 will be stopped when precisely the desired amount of material has been removed from the work piece 10 by this belt 184.

This disclosure of the grinder belt assembly 150 in FIG. 2 is at work station C, while the disclosure of the grinder belt assembly in FIG. 4 is at work station A. In the disclosure in FIG. 2, the belt grinder assembly is shown at its normal downward position as when the conveyor chains are moving the work pieces through the conveyor, while the full line disclosure in FIG. 4 is of the position assumed by the grinder belt assembly 150 when it is performing a grinding operation on the work piece 10 while the conveyor chains are stopped.

With the work pieces 10 fixedly positioned at work stations B and C, a rapidly rotating deburring wheel 224 having flexible strands of abrasive particles extending radially outwardly therefrom is brought down into contact with longitudinally extending leading edge portion 66 and longitudinally extending trailing edge portion 68 of the work piece 10, respectively, by a mechanism which can be seen most clearly in FIGS. 4 and 2. In FIG. 4, the positioning of the parts of a deburring assembly 226 in full lines is that which would prevail when the conveyor chains 38, 38 and 40 were moving the work pieces through the conveyor, and the positioning of the parts at the time the deburring assembly 226 including the deburring wheel 224 were actually operating on the work piece is shown in dotted lines. This is not consistent in this figure with the positioning of the parts of the belt grinder assembly 150; but the parts have been so illustrated in order to improve the clarity of the explanation and illustration.

The deburring wheel 224 is mounted on a deburring wheel shaft 228 and a deburring wheel shaft pulley 230 integral with shaft 228 (see FIG. 1) is operably connected to a deburring wheel motor 232 through the instrumentality of a deburring wheel drive belt 234 running on pulley 230 and on a motor pulley 236. Motor 232 and a bearing member 238 for deburring wheel shaft 228 are mounted on a platform 240 in pivoted relationship to the main frame 14, as at 242. A linear, air operated, piston-cylinder deburring wheel positioning motor 244 includes a cylinder 246 pivotally mounted with respect to the main frame 14 as at 248, a piston rod 250 pivotally mounted as at 252 with respect to the platform 240, and a piston 254 operably associated with the cylinder 246 and the piston rod 250.

With the work piece 10 clamped in position by a saddle block and jig at work station B, for example, hydraulic fluid will be introduced through lower air line 256 and into the head end of cylinder 246 to force the deburring assembly 226 from position as seen in full lines in FIG. 4 to position as seen in dotted lines in that figure. Because of the flexible nature of the materials from which the deburring wheel is made, it is not necessary to position the parts as accurately as at grinding work stations A and C, so any kind of simple or preferred adjustments such as illustrated by hand wheel 258 can be used to adjust the relationship of the deburring wheel 224 to work piece 10.

In operation, the grinder motors 160 and the deburring wheel motors 232 are activated. The conveyor drive motor 62 is activated to move the conveyor drive chains 38, 38, 40 and 46 in direction so that their upstanding conveyor chain drive tabs 54 will move work pieces 10 thereon in direction from right to left as seen in FIGS. 1 and 2 and from left to right as seen in FIG. 4. Each work piece is put on the conveyor at what arbitrarily has been designated as the front end of the apparatus at position as seen at 64 in FIG. 1, and is held there until a set of drive tabs 54 comes in contact with it and carries it forward with the outermost end 74 of its longitudinally extending leading edge portion 66 in contact with station A guide plate 70. As one work piece 10 is moved from position 64 (FIG. 1), another work piece is promptly positioned there so that it will be intercepted by the next set of drive tabs 54. As long as a work piece is positioned in front of each set of tabs as they come up into driving position on the front end of the conveyor, only one microswitch 86 situated at work station A will be needed to insure that each work piece is acted on at every work station, regardless of whether work pieces are subsequently rejected or for any other reason removed from the conveyor apparatus after passing work station A.

Figure 5:
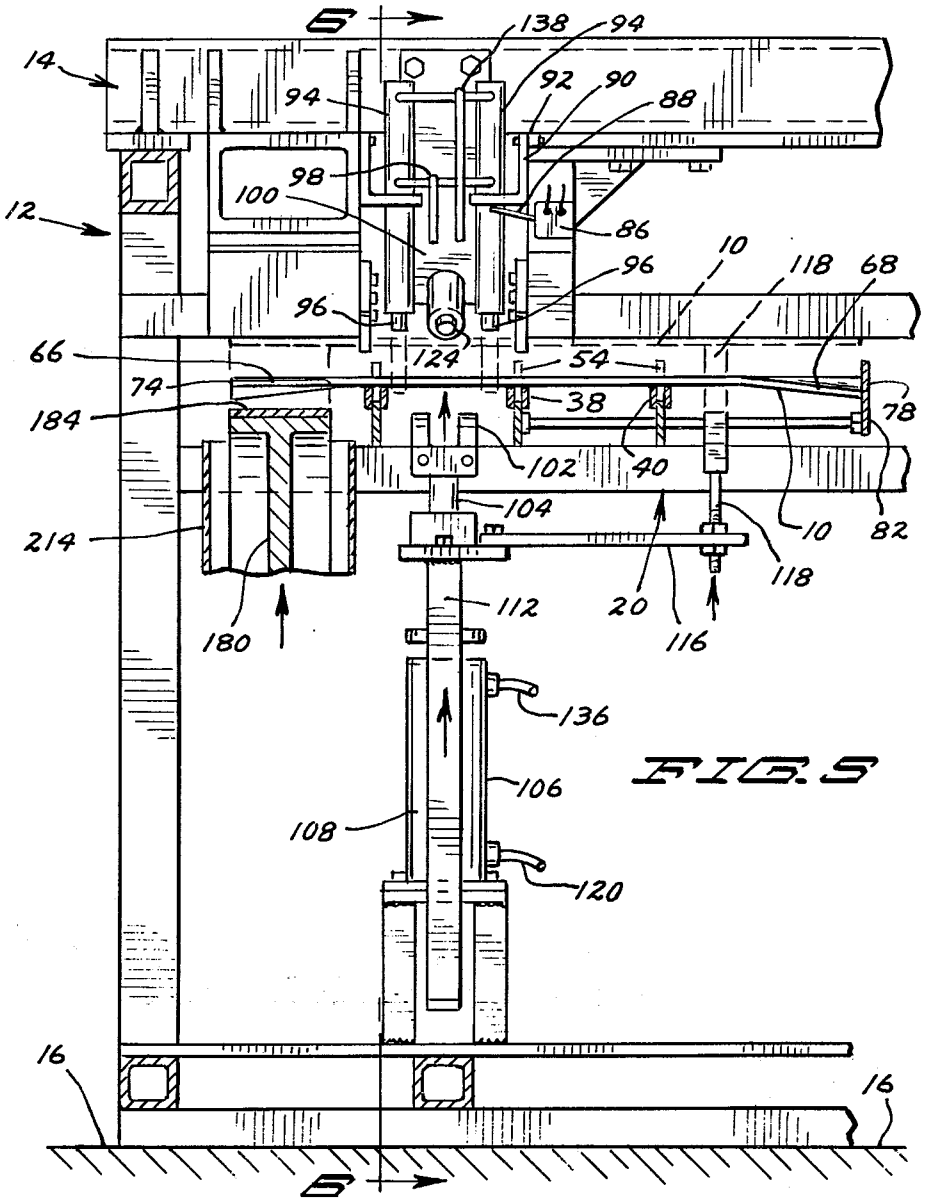
FIG. 5 is an enlarged fragmentary vertical sectional view taken on the line 5—5 in FIG. 5.

At the time that the conveyor chains are first made operative, the deburring assemblies 226 will be positioned as seen in FIG. 4 and as seen at work stations B and D in FIG. 2, while the belt grinder assemblies 150 will be positioned as seen at work stations A and C in FIG. 2 and as seen in FIGS. 3 and 5.

Once operation of arm 88 of microswitch 86 indicates the presence of a work piece 10 in contact with work piece stop fingers 96, 96 at work station A (or at another work station if controls are provided at the other stations), the drive of the conveyor chain will be immediately interrupted, and the saddle block motors 106 will be activated to cause the saddle blocks 102 to carry the work pieces aligned therewith up into fixed position with respect to the jigs 100. When each of the work pieces is correctly and securely so positioned, the belt grinder positioning motors 202 and the deburring wheel positioning motors 244 are activated to position the belt grinder assemblies 150 as seen in full lines in FIG. 4 and to position the deburring assembly 226 at position as indicated in dotted lines in FIG. 4. At this point, material is ground simultaneously from the longitudinally extending leading edge portion 66 of work piece 10 at work station A and from the longitudinally extending trailing edge portion 68 of the work piece 10 at work station C. At the same time the deburring operation is going on with respect to the longitudinally extending leading edge portion 66 of the work piece at work station B and with respect to the longitudinally extending trailing edge portion 68 of the work piece at work station D. When grinding at work stations A and C has created the desired cutting edges on the work piece blades 10, the direction of the drive of belt grinder positioning motors 202 and deburring wheel positioning motors 244 is reversed to cause the grinder and deburring assemblies to go back to their original positions. When this occurs, the four work pieces at the four work stations will be back on the surface of the conveyor chains, and the conveyor chain drive will be reinstituted to cause the drive tabs 54 to move the work pieces serially on to their next work station. Work pieces leaving work station D will be conveyed off of the end of the conveyor chains and will be picked up on a further conveyor or on a slide, or will drop into a storage bin, as desired, none of which has been shown.

While, as set out above, the operations instituted after a signal is received from a microswitch 86 may be automatic in nature through any usual or preferred control mechanisms, not shown, it is clear that, once a signal is received from a microswitch 86, the control steps could be performed manually. A combination of automatic and manual controls could also be used. For example, assuming the signal from microswitch 86 interrupted the power to conveyor drive motor 62, an operator, upon observing the interruption of the drive of the work pieces, can simultaneously open the head end of motors 202 and 244 to a source of air under pressure, thus instituting operation of the grinding and deburring procedures on the work pieces at each of the work stations, respectively; and can then introduce such air under pressure to the rod end of the motors 202 and the motors 244 when grinding operation and the deburring operations have been completed, thus backing off the belt grinder assemblies 150 and the deburring assemblies 226. After these assemblies are backed off, the operator can reinstitute the drive of the conveyor chains 38, 38, 40 and 46, which drive will proceed until the next work piece comes in contact with fingers 94, 94 to then again cause microswitch 86 to interrupt the conveyor chain drive.

The embodiments of the invention in which an exclusive property or privilege is claimed are defined as follows:

1. A method of sharpening a relatively flat, elongated, double ended rotary cutting blade using a belt sander having an abrasive grinder belt running over and rotating with a contact wheel, and using a rotating abrasive member having flexible abrasive elements extending outwardly therefrom, including the steps of:

A. bringing a moving abrasive belt backed by a rotating contact wheel of a belt sander into operational grinding relation to a longitudinally extending leading edge portion of a first end of a relatively flat, double ended rotary cutting blade to achieve a first sharpened cutting edge;

B. bringing such an abrasive belt backed by such a contact wheel into operational grinding relation to a longitudinally extending trailing edge portion of a second end of said blade to achieve a second sharpened cutting edge substantially identical to and opposite from said first edge;

C. removing burrs raised in the grinding steps by bringing said longitudinally extending leading edge portion at the first end of such blade and said longitudinally extending trailing edge portion at the second end of said blade each into operational abrading relationship to a rotating abrasive member having flexible abrasive elements extending outwardly thereof at position adjacent first and second cutting edges.

2. The method of claim 1 wherein step C is performed relative to said first end of said blade after step A has been performed and before step B has been performed; and wherein step C is performed on the second end of such blade after step B is performed.

* * * * *

UNITED STATES PATENT AND TRADEMARK OFFICE

CERTIFICATE OF CORRECTION

PATENT NO. : 3,940,889

DATED : March 2, 1976

INVENTOR(S) : Harland R. Hedlund et al

It is certified that error appears in the above-identified patent and that said Letters Patent are hereby corrected as shown below:

Line 5 of Abstract, "aapparatus" should be --apparatus--.

Column 1, line 36, "pressure" should be --preserve--.

Column 3, line 35, after "only" insert --by--.

Column 4, line 8, "5" should be --4 -.

Column 4, line 24, "30" should be --20--.

Column 4, line 44, "bearing" should be --bearings--.

Column 7, line 46, "agains" should be --again--.

Column 8, line 62, "close" should be --closer--

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*